US010920489B2

(12) United States Patent
Lombardini

(10) Patent No.: US 10,920,489 B2
(45) Date of Patent: Feb. 16, 2021

(54) UPRIGHT FOR A SHADING SYSTEM, REMOVABLE FLANGE OF THE UPRIGHT AND CORRESPONDING COUPLING MEANS

(71) Applicant: PLASTEX SA, Madonna del Piano (CH)

(72) Inventor: Marco Lombardini, Vernate (CH)

(73) Assignee: PLASTEX SA, Madonna del Piano (CH)

( * ) Notice: Subject to any disclaimer, the term of this patent is extended or adjusted under 35 U.S.C. 154(b) by 206 days.

(21) Appl. No.: 15/549,085

(22) PCT Filed: May 25, 2016

(86) PCT No.: PCT/EP2016/061836

§ 371 (c)(1),
(2) Date: Aug. 4, 2017

(87) PCT Pub. No.: WO2016/193103

PCT Pub. Date: Dec. 8, 2016

(65) Prior Publication Data

US 2018/0094481 A1 Apr. 5, 2018

(30) Foreign Application Priority Data

May 29, 2015 (EP) ..... 15169794

(51) Int. Cl.
*E06B 9/58* (2006.01)

(52) U.S. Cl.
CPC ..... *E06B 9/58* (2013.01); *E06B 2009/587* (2013.01)

(58) Field of Classification Search
CPC ..... E06B 9/58; E06B 2009/587; E06B 2009/588; E06B 9/42; E06B 9/581; E06B 2009/585

(Continued)

(56) References Cited

U.S. PATENT DOCUMENTS 5,526,865 A * 6/1996 Coenraets ..... E06B 9/58 160/272
9,205,729 B2 * 12/2015 Hiramatsu ..... B60R 13/0231

(Continued)

FOREIGN PATENT DOCUMENTS

DE 3443470 A1 5/1986
EP 2738341 A2 6/2014

(Continued)

OTHER PUBLICATIONS

International Search Report for International Patent Application No. PCT/EP2016/061836, dated Aug. 26, 2016 (3 pages).

(Continued)

*Primary Examiner* — Daniel P Cahn

(74) *Attorney, Agent, or Firm* — Dorsey & Whitney LLP

(57) ABSTRACT

An upright including two flanks between which a profiled element for a shading system can be inserted is described. At least one of the flanks is associated with a removable flange, and a damping device is arranged between the removable flange and a base of the upright so as to retain the flange between the base and the flank. Furthermore, the removable flange of the upright and the damping device for fixing the flange to the upright are described. The damping device includes a channel with a substantially C-shaped cross-section which is mounted on an edge of the removable flange, and a flexible plastic tongue having one end on the channel and an opposite end at a distance therefrom and making contact with the base of the upright.

9 Claims, 12 Drawing Sheets

(58) Field of Classification Search
USPC ..... 160/368.1
See application file for complete search history.

(56) References Cited

U.S. PATENT DOCUMENTS

| | | | | |
|---|---|---|---|---|
| 9,458,666 | B2 * | 10/2016 | Murray | E06B 9/581 |
| 9,982,483 | B2 * | 5/2018 | Nakae | E06B 9/42 |
| 10,731,412 | B2 * | 8/2020 | Roberts | E05D 15/0621 |
| 2014/0076507 | A1 * | 3/2014 | Dibben | E06B 9/58<br>160/272 |
| 2015/0345215 | A1 * | 12/2015 | Roberts | E06B 9/582<br>160/368.1 |
| 2018/0023341 | A1 * | 1/2018 | Lombardini | E06B 9/582<br>160/368.1 |
| 2019/0048658 | A1 * | 2/2019 | Garcia Hernandez | E06B 9/44 |

FOREIGN PATENT DOCUMENTS

| | | | | |
|---|---|---|---|---|
| EP | 3098376 | A1 | 11/2016 | |
| WO | 2009098433 | A1 | 8/2009 | |
| WO | WO-2009098433 | A1 * | 8/2009 | E06B 9/581 |
| WO | 2013128160 | A1 | 9/2013 | |
| WO | 2016193103 | A1 | 12/2016 | |

OTHER PUBLICATIONS

Written Opinion of the International Searching Authority for International Patent Application No. PCT/EP2016/061836, dated Aug. 26, 2016 (7 pages).

* cited by examiner

--Prior Art--

--Prior Art--

UPRIGHT FOR A SHADING SYSTEM, REMOVABLE FLANGE OF THE UPRIGHT AND CORRESPONDING COUPLING MEANS

FIELD OF APPLICATION

The present invention relates to an upright comprising two flanks between which a profiled element for a shading system can be inserted, said profiled element being intended to receive the edge of a shading screen which extends as far as the profiled element of an oppositely arranged upright.

The present invention also relates to a removable flange of the aforementioned upright, designed to allow mounting or removal of the profiled element through a front opening of the upright.

The present invention also relates to means for coupling together the upright and the removable flange mentioned above.

Finally, the invention relates to a simplified method for mounting a removable flange in an upright of a shading system.

PRIOR ART

As is known, an upright for a shading system is formed by a base and by two side walls.

For example, with reference to FIG. 1, a side wall 70 is integrated in the upright 90 and the other lateral part 80 is removable from it so as to allow mounting or removal of a profiled element (not shown) via a seat S. The seat S has an opening A with a width A corresponding to the distance between the side walls 80, 70 and in particular to the distance between two front portions 71, 81 of the walls, which form the end face 92 of the upright 90 and which, during use, form a profile for retaining the profiled element.

The removable side wall 80 is fixed to a framework 91 of the upright 90 by means of screws which pass through the front portion 81 and engage inside respective threaded holes 93 in the framework. In order to ensure suitable fixing, at least three threaded holes are provided: one hole corresponding to the central part of the upright, i.e. halfway along the height, and two other holes, towards the top and towards the bottom.

FIG. 1*a* shows a horizontally sectioned view of two uprights 90 according to the prior art, arranged in position inside two respective seats formed in a wall 999, on the sides of an opening A'. In particular, the base 6 of the uprights is set inside the wall 999 and the end face 92 is flush with the wall 999. A profiled element 100 is mounted inside each upright 90 and has, extending therefrom towards the profiled element 100 of the oppositely arranged upright, a screen for shading the light passing through the opening A'.

Even though widely used, the known upright has a number of drawbacks which complicate and slow down assembly and increase its production costs.

In fact, the provision of the threaded holes 93 in the framework requires machining of the upright. Moreover, during assembly, it is not practical nor easy to screw the screws inside the threaded holes 93, especially in view of the limited amount of space available for manoeuvre between the side walls 80, 70 and the difficulty of locating the holes 93 along the framework, once the side wall 80 has been fitted. Often these difficulties result in incorrect assembly or damage to the end face (front portions 72, 82) of the upright.

Even following correct assembly, the aesthetic effect is not particularly satisfactory, because the front portion 92 of the removable side wall 80 in any case has holes, with the screws visible. The application of stucco or resin in order to seal the holes is never a particularly elegant solution for the end face of the upright. Examples of prior art uprights for a shading system are given in WO 2013/128160, DE 34 43 470, WO 2009/098433 and EP 2 738 341.

The technical problem forming the basis of the present invention is to devise an upright for a shading system, a corresponding removable side wall, and corresponding means for coupling together the removable wall and the upright, which overcome the abovementioned problems, speeding up and simplifying the assembly and disassembly operations, reducing the costs for production of the upright, while also improving its structure and its aesthetic appearance, such that it is not affected by all the limitations which affect the shading uprights according to the prior art.

SUMMARY OF THE INVENTION

The idea forming the basis of the present invention is that of devising an upright comprising a removable flange which can be engaged by means of quick insertion, for example snap-engagement, inside the upright, said flange being structured to form a profile for retaining a profiled element for a shading system inside the upright and an end face of the upright without holes.

According to one aspect of the present invention, the removable flange is inserted inside a seat or channel which slides longitudinally along the upright, along one flank thereof, and inside which seat elastic means situated between the flange and the base of the upright operate so as to retain the flange between the base and the flank.

Advantageously, mounting of the removable flange is performed by fitting the flange into the seat, without screws, and removal is performed by extracting the flange from the seat, by means of a simple operation involving compression of the elastic means. No hole is provided on the end face of the upright bounded by the removable flange. Moreover, the upright of the present invention may be installed flush with the wall situated alongside a window, with the base of the upright inset in the wall and the end face of the upright flush, or so to form so-called continuous facades. In this case, as will become clear from the detailed description of the invention, the upright is arranged between two adjacent openings and forms two seats for two profiled elements, i.e. a first profiled element associated with a screen which extends in a first direction, so as to cover a first opening in the continuous facade, and a second profiled element, associated with another screen which extends in a second direction, so as to cover a second opening in the continuous facade of a building.

According to the proposed solution mentioned above, the technical problem is solved by an upright comprising two flanks between which a profiled element for a shading system can be inserted, wherein at least one of the flanks is associated with a removable flange, and elastic means are arranged between the removable flange and a base of the upright, in order to retain the flange between the base and the flank, the upright further comprising the characterized of claim 1 of the present application.

According to one aspect of the invention, the flank associated with the removable flange comprises a side wall and a shoulder, substantially parallel to the side wall and forming, with the base of the upright, the channel or seat for receiving the flange inside which the elastic means operate, pushing the flange from the base of the upright towards a locating element on the flank.

The elastic means include a damping device comprising a channel, with a substantially C-shaped cross-section, which is mounted on an edge of the removable flange, and a flexible plastic tongue having one end on the channel and an opposite end at a distance therefrom and making contact with the base of the upright. Advantageously several damping devices may be easily and quickly mounted on the edge of the channel, with a predefined or variable spacing from each other, so as to exert a pressure along the entire flange, improving fixing inside the upright.

According to one aspect of the invention, the flank comprises a rigid wall and the removable flange may be engaged inside an undercut of the rigid side wall. The rigid side wall forms a side of the upright and is formed as one piece with the upright.

The removable flange comprises an end face which defines a front profile of the upright and a side wall which is perpendicular to the end face and comprises the edge on which the elastic means (damping device) are mounted. The lateral part of the flange has substantially the same length as the end face, but advantageously may be narrower than the end face, owing to the presence of the elastic means between base and flange. Also owing to its smaller width, such a flange may be more easily mounted compared to the removable flanges of the prior art.

The other flank of the upright comprises a respective end face which defines another front profile of the upright. According to one aspect of the present invention, said respective end face is incorporated in the upright. Advantageously, according to this aspect of the invention, the opposite flanks, the base and an end face are formed as one piece.

The end faces of the removable flange and of the other flank of the upright form a profile for retaining the profiled element for the shading system. In particular, during use, the profiled element of the shading system makes contact with an internal surface of the end faces, preferably with an edge folded towards the inside of the upright.

According to another embodiment of the present invention, both the flanks of the upright are associated with a respective removable flange and respective end faces of the flanks form a profile for retaining the profiled element. In this case it is envisaged first mounting one flange on a respective flank, then inserting the profiled element between the flange and the other flank, and then mounting the second flange.

Preferably, a plurality of damping devices are mounted with a predefined or variable spacing on the edge of the removable flange. The spacing is preferably between 15 cm and 20 cm.

The upright claimed in the present invention may comprise also the profiled element of the shading system and a plurality of clips 10 provided with a channel having a substantially C-shaped cross-section mounted on an edge of the profiled element, and a flexible plastic tongue 20 having one end on the channel of the clip 10 and an opposite end at a distance therefrom so as to make contact with the upright, along the inner surface of its end faces, said tongue 20 of the clip 10 acting as a spring between the profiled element and the upright, allowing the profiled element to move towards the end faces of the upright during compression or be arranged at a predefined distance when there is no compression.

The upright claimed in the present invention may also comprise the profiled element of the shading system with other damping systems between the profiled element and the end face of the upright, for example a damping sponge fitted on all or part of the length of the profiled element.

According to a preferred embodiment of the present invention, which has a particularly attractive appearance, the end face of the removable flange and end face of the other flank of the upright extend towards each other so as to define a very narrow opening of the upright, substantially sufficient to allow only the shading screen to pass through. In other words, the end face of the upright is nearly closed and has only a narrow slit for allowing the screen to pass through. This embodiment is also possible using two removable flanges which are associated with the flanks, it being envisaged that the end face of one flange extends towards the end face of the other flange so as to nearly touch it.

The abovementioned technical problem is also solved by a damping device for a shading system, comprising a channel with a substantially C-shaped cross-section for fixing the damping device to an edge of a removable flange of an upright, and a flexible plastic tongue having one end on the channel and an opposite end at a distance therefrom so as to make contact with a base of the upright, the tongue of the damping device being intended to act as a spring between the removable flange and the upright, allowing the flange to be moved towards the base during assembly/disassembly, or the flange to be retained inside the upright, after assembly, wherein a base of the channel has a predefined width (B) and two flanks of the channel are adapted to contact opposed surfaces of the removable flange.

Preferably, the two flanks of the channel preferably converge from the base towards the opening of the C-shaped cross-section, so as to produce a pressing contact on the removable flange, and at least one of the flanks comprises a lug, preferably having a tip directed towards the inside of the channel, adapted to enter in a respective guide of the flange.

The flexible tongue has one end on the base of the channel and another end distanced from the base outside the channel. Preferably, the damping device is made entirely of plastic. According to one embodiment, various plastic materials are co-extruded so as to form, respectively, the damping tongue and the channel.

According to one aspect of the invention, a base of the channel has a predefined width and two flanks of the channel preferably converge from the base towards the opening of the C-shaped cross-section, so as to produce pressing contact on the removable flange.

At least one of the flanks comprises a lug with a tip directed towards the inside of the channel, which is designed to prevent the removable flange from coming out of the channel and is preferably designed to engage inside an incision formed along the flange. The flanks of the channel are substantially perpendicular to the base and the end of the tongue connected to the channel is associated with the base.

According to one aspect of the invention, the channel is formed as one piece with the tongue, for example being formed by means of extrusion and/or made of polypropylene. The channel has for example a length of between 2 cm and 7 cm.

According to one aspect of the present invention, the damping device is formed by a single channel and by a plurality of tongues having one end on the channel and an opposite end at a distance therefrom; the channel is intended to be mounted on the edge of a removable flange and the tongues are intended to come into contact with the base of the upright.

For example, the channel is as long as the removable flange and is mounted on the edge of the flange. The tongues may be formed by performing punching with predefined spacing along the channel; in this case the channel has a plurality of holes opposite the punched tongues. However, according to this aspect of the invention, it is also possible to perform a different machining operation, with the aim of forming several tongues projecting from the back of a single channel.

The abovementioned technical problem is solved also by a removable flange of an upright for a shading system, comprising an end face intended to form the front profile of the upright and a side wall which can be engaged inside an undercut of a flank of the upright and on which a damping device of the type indicated above is mountable or is mounted.

The abovementioned technical problem is also solved by a method for assembling an upright comprising two oppositely arranged flanks which define a seat for a profiled element of a shading system, the method comprising the steps of:

mounting elastic means on a removable flange of the upright, the elastic means including a damping device (200) comprising a channel (210), with a substantially C-shaped cross-section, which is mounted on an edge (41) of the removable flange (4), and a flexible plastic tongue (220) having one end on the channel (210) and an opposite end at a distance therefrom and making contact with a base (6) of the upright (1);

mounting the removable flange on the upright, said mounting step comprising compression of the elastic means against a base of the upright, so as to position the flange underneath locking means situated on a flank of the upright, and a step of elastically releasing said elastic means, which causes the flange to be wedged between the base and the locking means on the flank.

The method is also applicable when a profiled element has already been inserted in the upright. In particular, the method comprises the step of inserting a profiled element of a shading system between the flanks of the upright, before mounting the removable flange, subsequent mounting of the removable flange comprising the step of compressing several clips fixed to the profiled element of the shading system by means of the removable flange.

DETAILED DESCRIPTION

Figure 1:
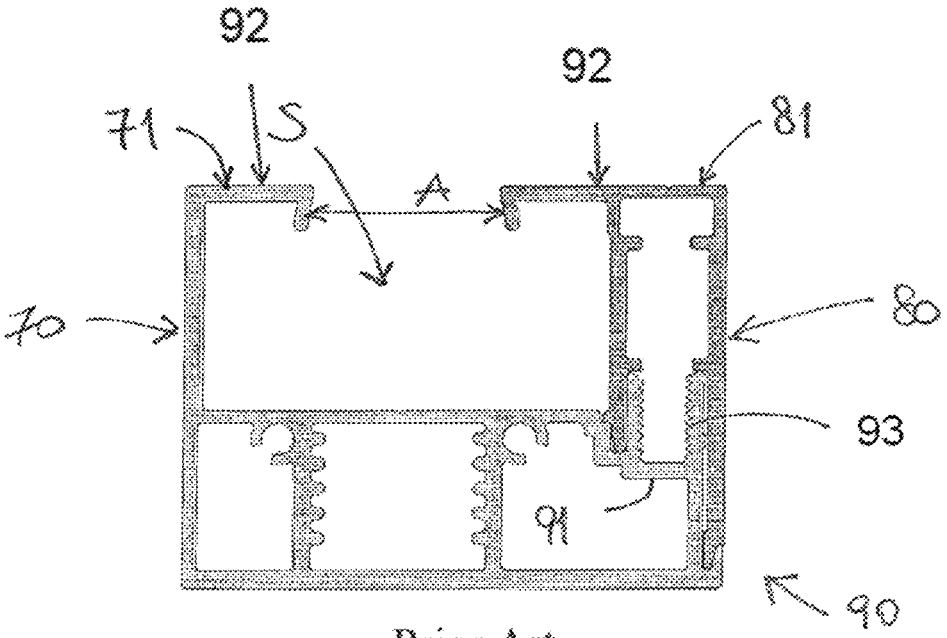
FIG. 1 is a cross-sectional view of an upright for a shading system according to the prior art.
Figure 2A:
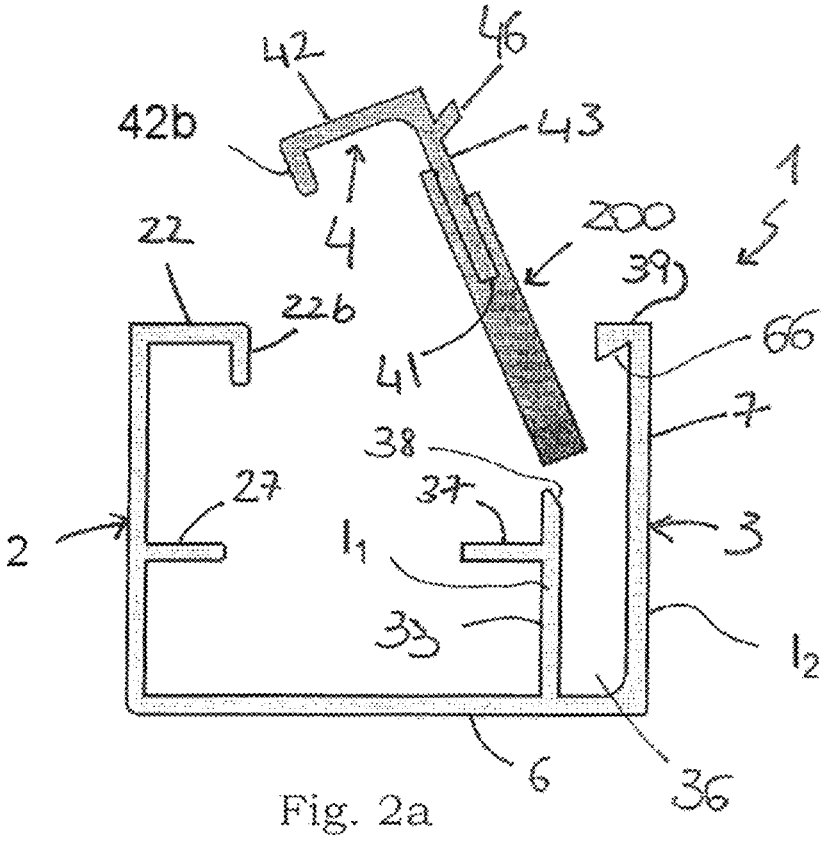
FIGS. 2*a*-2*d* are cross-sectional views of an upright according to the present invention and schematically show, in succession, the step of mounting a removable flange of the upright on one flank of the upright.
Figure 1A:
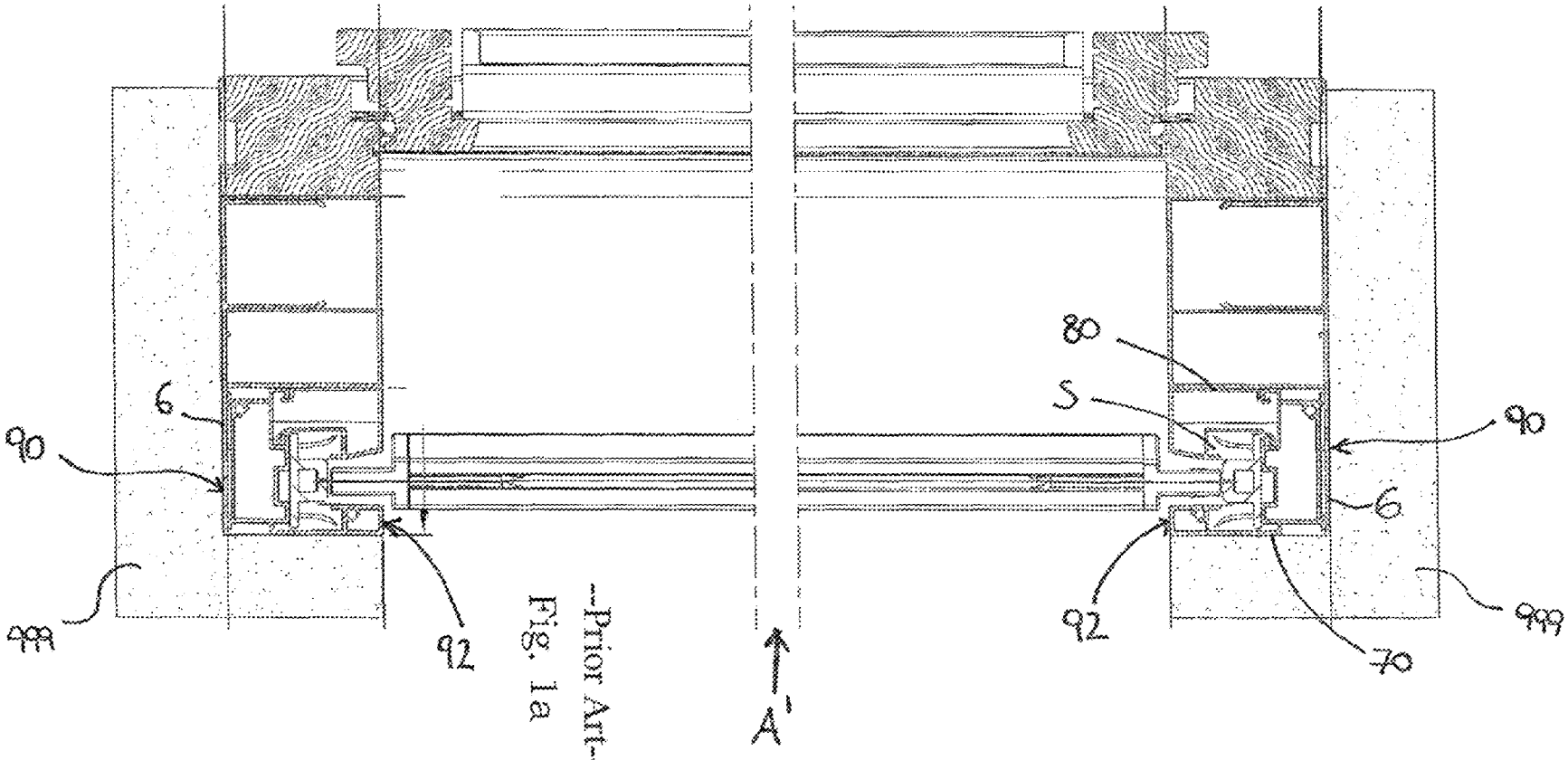
FIG. 1*a* is a horizontal cross-sectional view of an upright for a shading system according to the prior art, mounted flush with a wall.
Figure 2B:
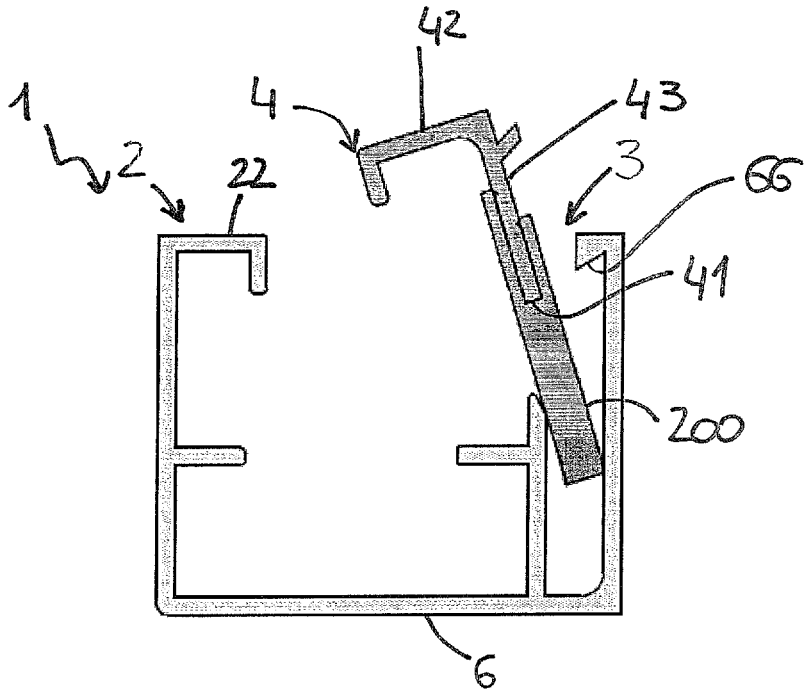
Figure 2C:
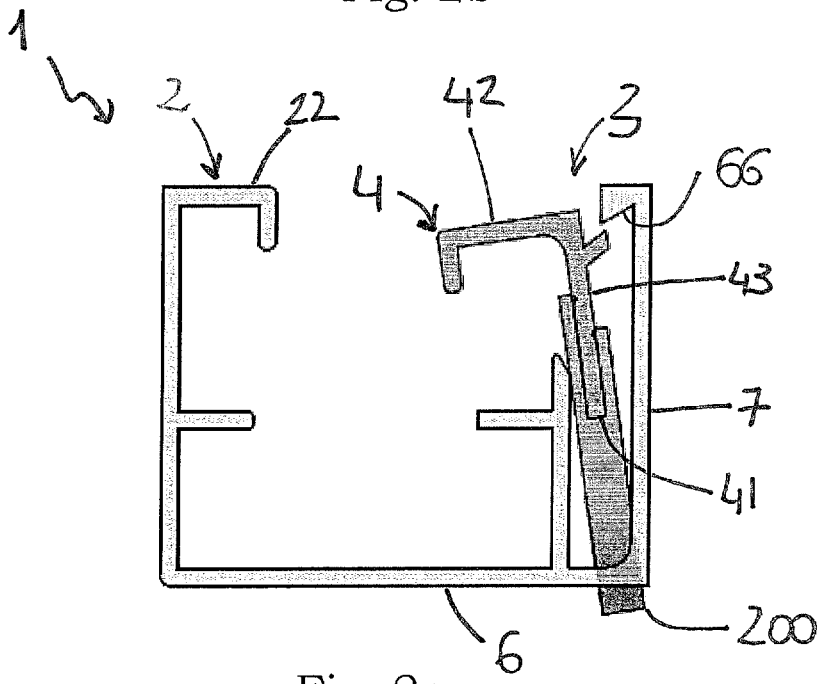
Figure 2D:
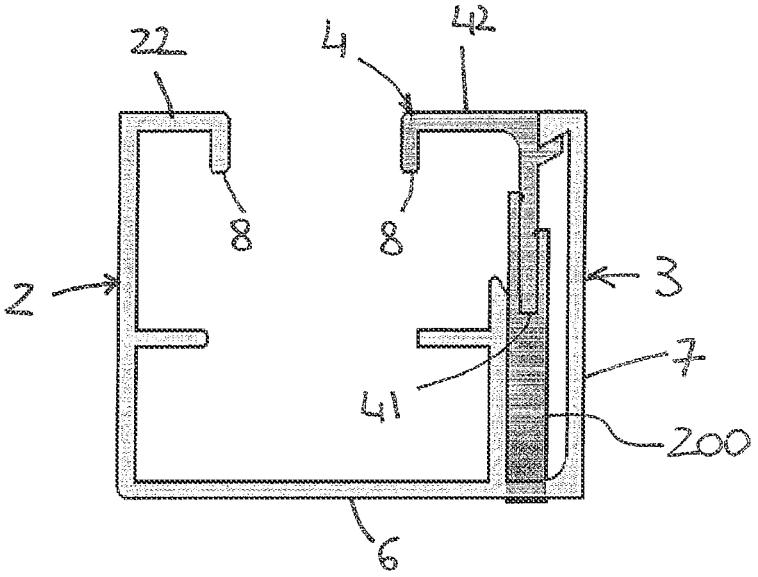
Figure 3:
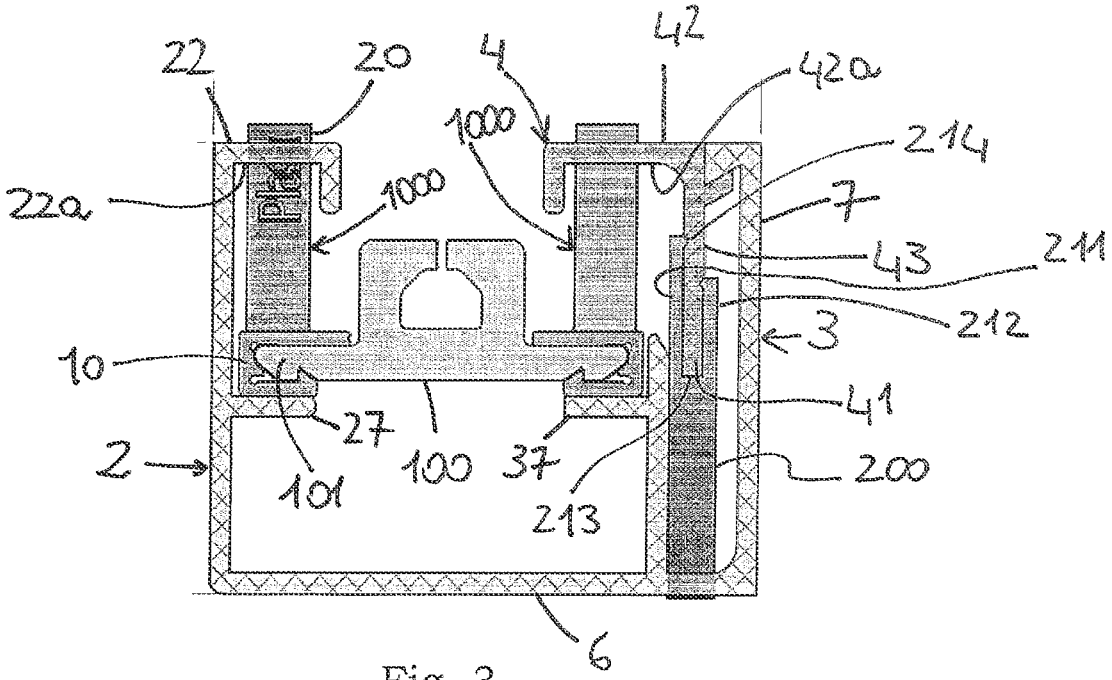
FIG. 3 is a cross-sectional view of the upright according to the present invention and a profiled element inserted inside it.

With reference to FIGS. 2*a*-4, these show in schematic form an upright according to the present invention and in particular an upright 1 intended to receive between its flanks 2, 3 a profiled element 100 for a shading system (FIG. 3). The profiled element 100 is associated with a screen or shading means (not shown) which extend as far as the profiled element of an oppositely arranged upright.

The upright 2*a* has a substantially C-shaped structure comprising a base 6 and two flanks 2, 3, preferably made as one piece. A support wall 33, parallel to one of the side faces 3, forms together with the base 6 a seat or channel 36 which runs longitudinally along all or part of the upright 1 and is designed to receive a removable flange 4 of the upright.

The flanks 2, 3 are also provided with a support surface 27, 37 for the profiled element 100 (FIG. 3), preferably made as one piece. In particular, the support surface of the flank 3 associated with the seat 36 is formed on the support wall 33.

The removable flank 4 is associated with elastic means 200 and is inserted inside the upright 1, with the elastic means inside the seat 36, operationally arranged between an edge 41 of the flange 4 and the base 6 of the upright.

Locking means 66, for example a tooth along the internal surface of the flank 3, form a stop surface for the flange 4, for example for a tooth 46 on a side wall 43 of the flange 4. When the parts are assembled, the flange 4 is engaged or wedged between the base 6 of the upright and the locking means 66, with the elastic means 200 arranged in between.

The support wall 33 has preferably a width $l_1$ smaller than the width $l_2$ of the flank 3 and allows easy insertion of the elastic means 200 inside the seat 36, even in the presence of the tooth 66 projecting towards the inside of the upright 1. An edge 38 of the support wall 33 is chamfered and forms a surface for sliding/guiding the elastic means and/or the flange 4 inside the seat 36. An angle formed between the base 6 and the flank 7, inside the seat 36, opposite the support wall 33, is chamfered or rounded and serves to guide the elastic means 200 inside the seat 36 during assembly of the flange 4, favouring correct positioning thereof inside the seat 36. Essentially the rounded angle allows the elastic means to be slid as far as the base 6 where they are stably supported, ensuring axial gripping of the flange 4 inside the upright. Preferably, the elastic means 200 are provided with a curved tongue 220 having a flat surface intended to rest on the base 6 of the upright, when the parts are assembled. The absence of a sharp corner between the base 6 and the side 7 prevents the tongue 220 from getting stuck in the corner during assembly and ensures correct positioning of the elastic means.

Figure 4:
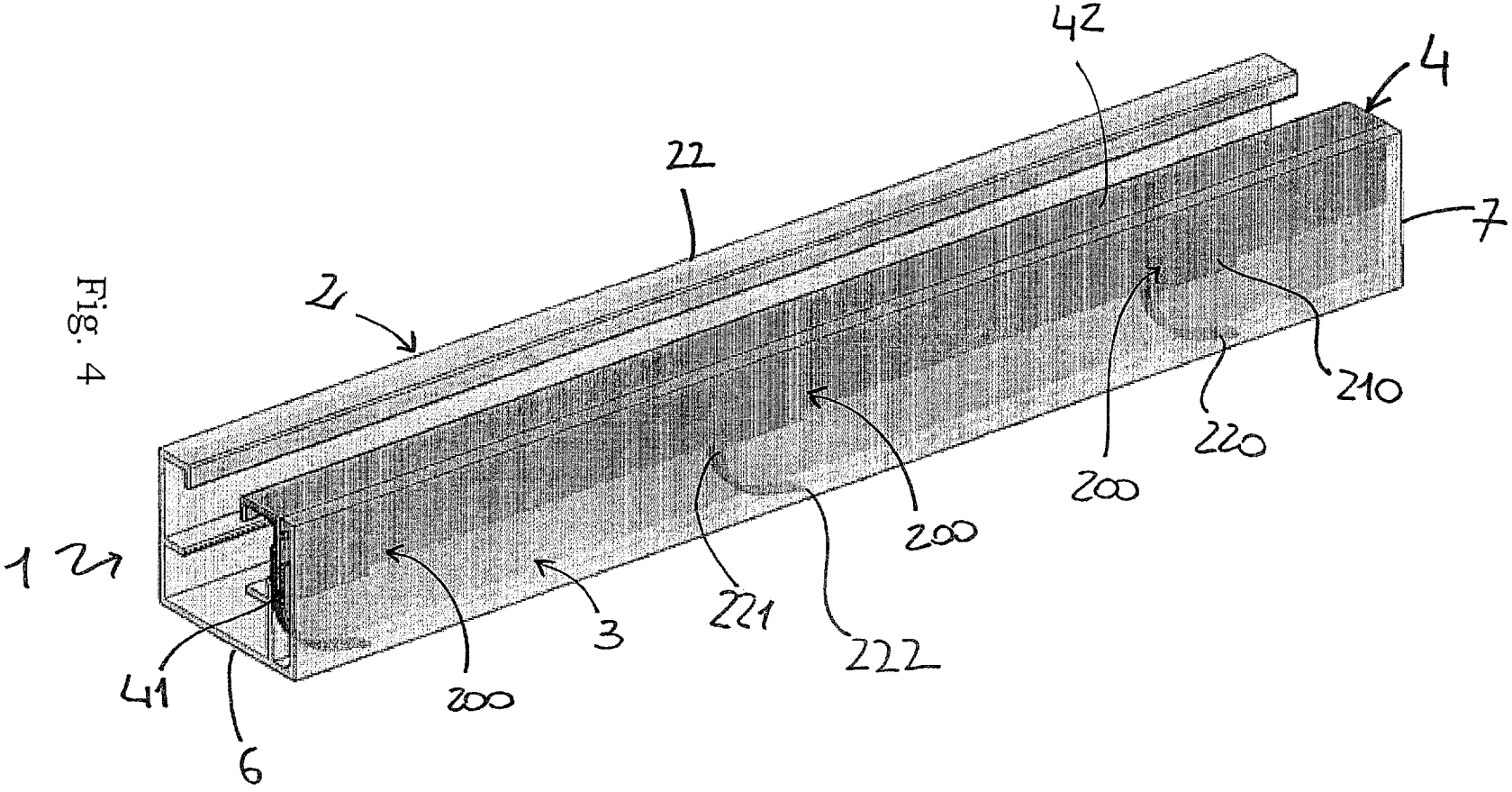
FIG. 4 is a perspective and partially transparent view of the upright according to the present invention.

The elastic means 200 comprise a damping device provided with a channel 21 mounted on the edge 41 of the flange and the flexible tongue 220 (FIG. 4). The channel has two flanks 211, 212, at least one of them being provided with a lug 214, preferably having a tip 215 directed towards the inside of the channel, designed to prevent the flange 4 from coming out of the channel 210. The flange 4 is provided with a respective guide for the tip 215, preferably along the entire length of the flange 4, so as to allow rapid mounting of several damping devices 200 with a predefined or variable spacing. Insertion is performed by means snap-engagement. Preferably, the tongue 220 of the damping device is flexible and the channel is rigid.

According to one embodiment of the present invention, the damping device 200 is formed by a single channel 210 and by several flexible tongues 220 on the channel. The tongues 220 have one end 221 on the back of the channel 210 and an opposite end 222 at a distance therefrom. The channel 210 is intended to be mounted on the edge 41 of a removable flange 4 and the tongues 220 are intended to come into contact with the base 6 of the upright 1.

For example, the channel 200 is as long as the removable flange 4 or as a section of the flange 4 and is mounted on the edge 41 of the flange by means of snap-engagement, causing a tip or lug 215 directed towards the inside of the channel 210 to enter inside a guide formed in the thickness of the flange 4.

The tongues 220 may be formed by means of punching with predefined spacing P along the channel 210; in this case, the channel 210 has a plurality of holes 223 opposite the punched tongues 210. However, it is also possible to perform a different machining operation, with the same aim of forming several tongues 210 projecting from the back of only one channel 210 of the damping device 200. The flange 4 comprises an end face 42 which also forms part of the end face of the upright 1, a remaining part being defined by an end face 22 of the flank 2. In one embodiment, at least also a portion 39 of the side face 3 associated with the removable flange 4 defines a part of the end face of the upright 1.

The end faces 22, 42 also form the profile 8 for retaining the profiled element 100 (FIG. 3). Said retaining profile is preferably formed by surfaces of the end face 2 and the flange 4 which are parallel to the base and by an edge 22*b*, 42*b*, folded towards the inside of the upright, of the end face 22 and the flange 42.

When the parts are assembled, the retaining profile partly receives elastic means 1000 intended to cooperate between the profiled element 100 and the end faces 22, 42 and to dampen the effects of gusts of wind on the screen, tending to displace the screen between the uprights 11. The elastic means 1000 also perform other useful functions in the shading system and in particular serve to compensate for billowing of the screen and/or to compensate for tolerances in the manufacture thereof, keeping it properly taut and substantially wrinkle-free, for example in the case of sudden changes in temperature which have a sudden and reversible effect on the length of the screen, or in the case of irreversible changes in the length of the screen, caused by wear over time.

In FIG. 3 the end faces 22 and 42 are spaced from each other and define an opening visible from the front of the upright.

According to a preferred embodiment of the present invention, the end face 42 of the removable flange and end face 22 of the other flank of the upright extend towards each other until they nearly touch each other, defining an opening which is very narrow, substantially sufficient to allow only the shading screen to pass through. Therefore, with a considerable advantage for the aesthetic appearance of the upright, the end face of the upright 1 is practically closed. The same effect may be achieved using two removable flanges 42, associated with the respective flanks 2, 3, with the end face of one flange 4 extending towards the end face of the other removable flange (not shown) until it nearly touches it.

FIGS. 2*a*-2*c* show in schematic form the operating steps for assembly of the flange 4 on the upright. The damping devices 200 which are mounted on the flange 4 are initially introduced inside the upright (FIG. 2*a*) and slid inside the seat 36 along the surface 38 of the shoulder 33 (FIG. 2*b*) until they touch the base 6 of the upright. Then the elastic means 200 are compressed (FIG. 2*c*) so as to position the tooth 46 of the flange 4 underneath the tooth 66 of the flank 3. At this point, the lateral part 43 of the flange 4 is pushed towards the internal surface of the flank 3 and is released (FIG. 2*d*), thus allowing the elastic means 200 to expand, pressing against the tooth 66 and thus fixing the flange 4 between the base 6 of the upright and the flank 3.

The operations of removal of the flange are equally simple and consist in compressing the elastic means 200 towards the base, so as to disengage the flange 4 from the flank 3, and inclining the flange 4 towards the opening of the upright 1, for extraction thereof.

According to one aspect of the present invention, the upright 1 is inset in the wall. Essentially, according to this aspect of the invention, the wall is interrupted in the region of an opening having a depth corresponding to the thickness of the wall. The opening is defined by two side shoulders of the wall, the ceiling or lowered part thereof and the floor (in the case of French windows) or by a shelf at a predetermined height from the floor (in the case of a window). The upright may then be inset in the shoulders of the wall, with the base 6 which is inserted to a predetermined depth in the shoulder of the wall and the end face flush with the shoulder. According to this embodiment, the upright when installed is invisible and the screen extending between the two uprights is aligned with the shoulder of the wall in an attractive manner. This installation arrangement is possible owing to the removable flange which may be easily removed from the upright, in order to insert or extract the screen. According to another aspect of the invention, the upright is not inset in the shoulders, but is applied on the outside of the wall shoulders. In this case the end faces 2 and 3 are visible.

Figure 5A:
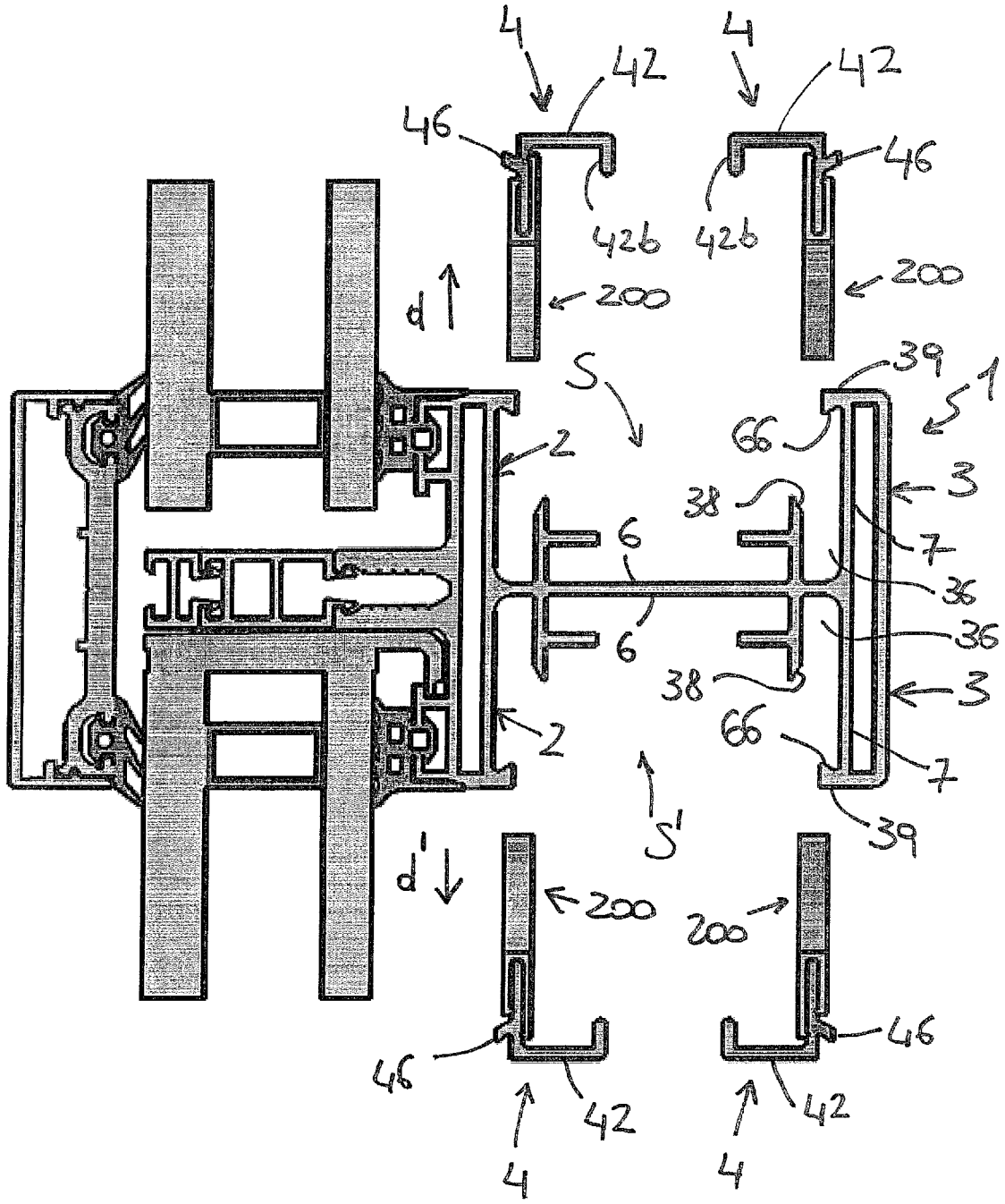
FIGS. 5*a*-5*f* show in schematic form the steps of mounting removable flanges on an upright for continuous facades, according to the present invention.
Figure 5B:
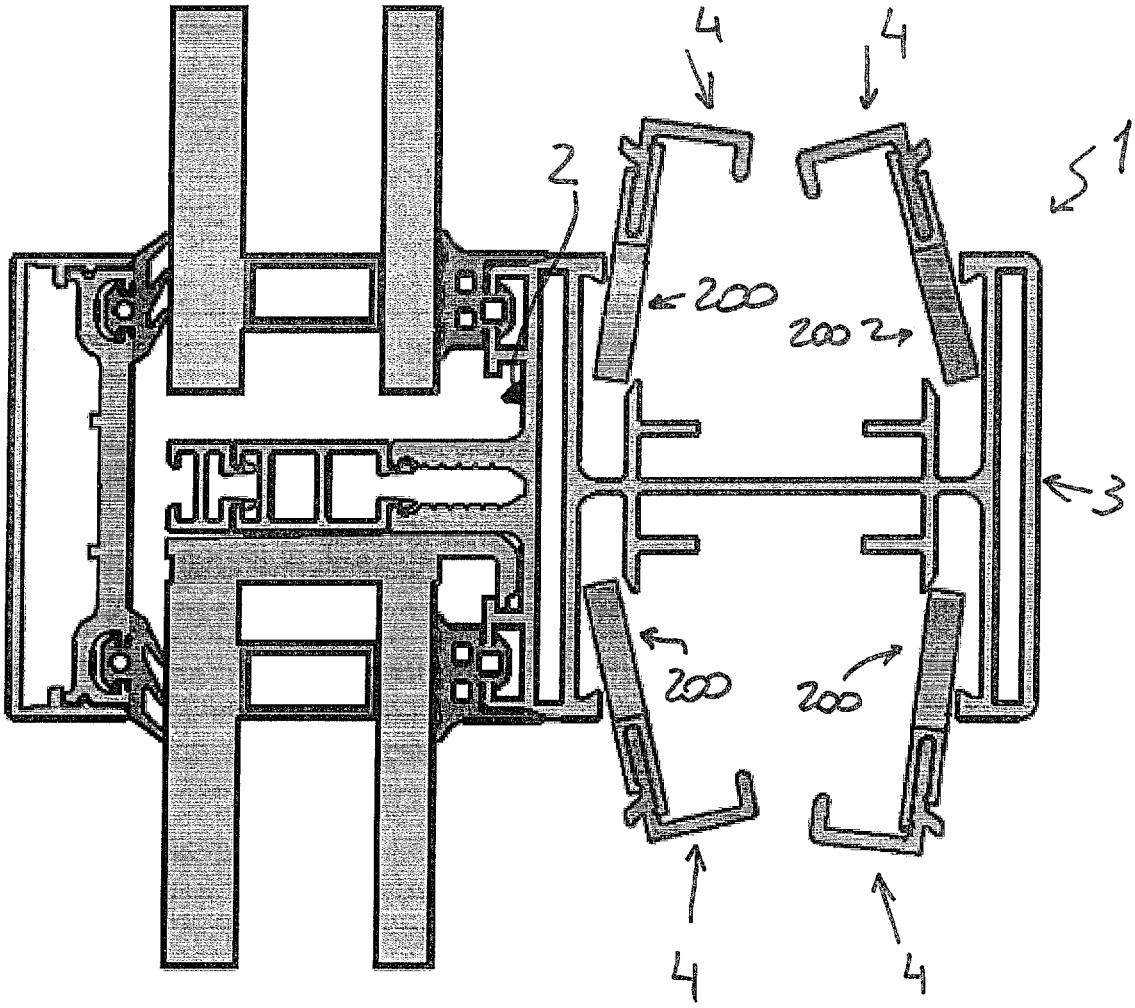
Figure 5C:
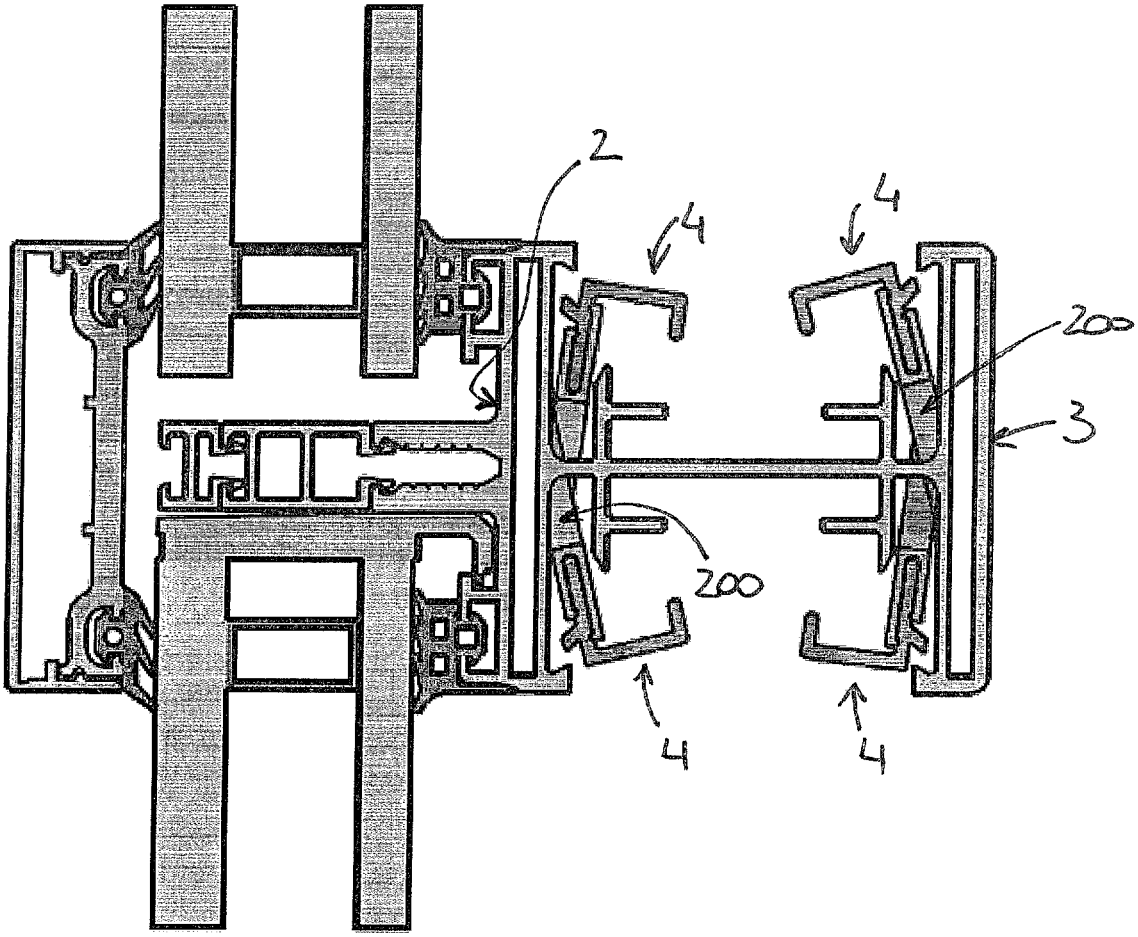
Figure 5D:
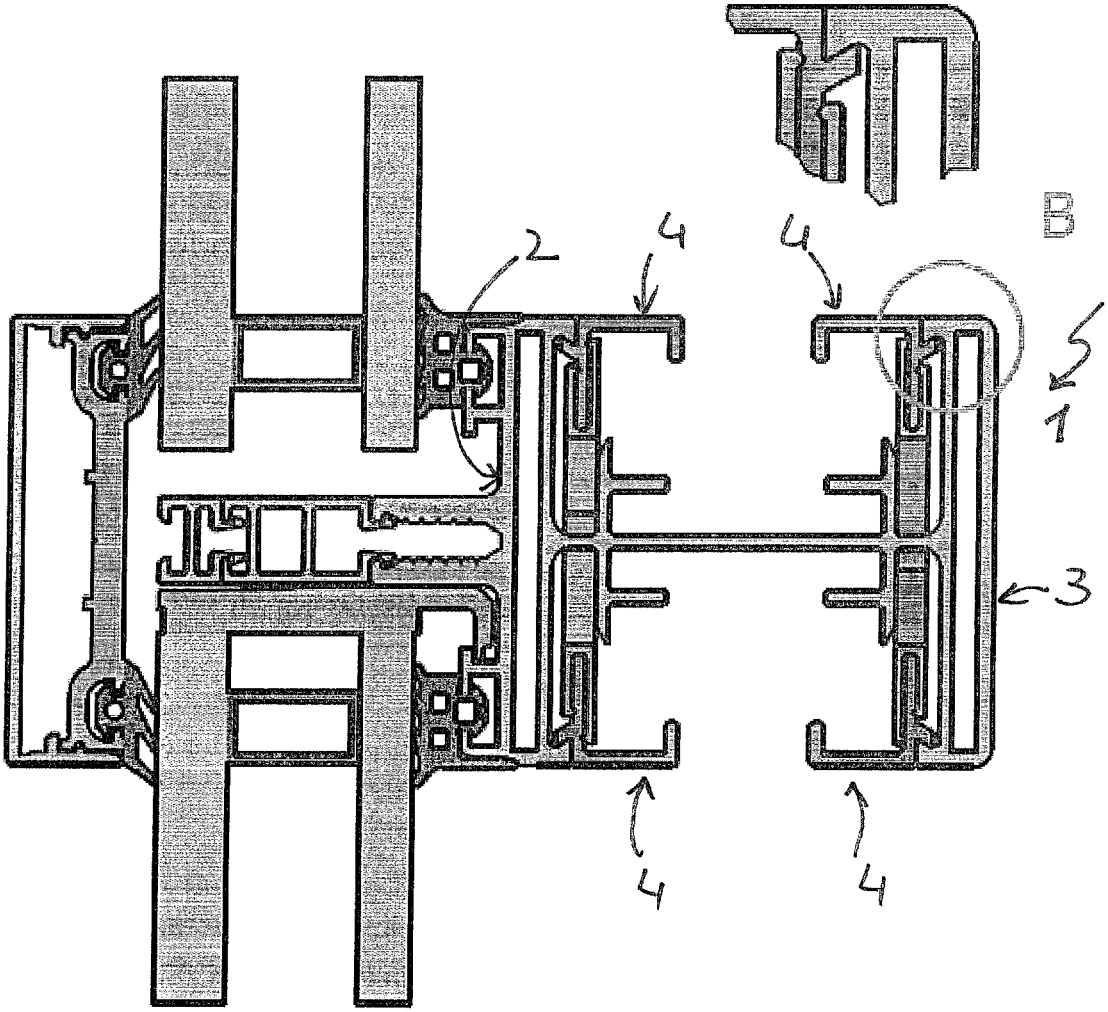
Figure 5E:
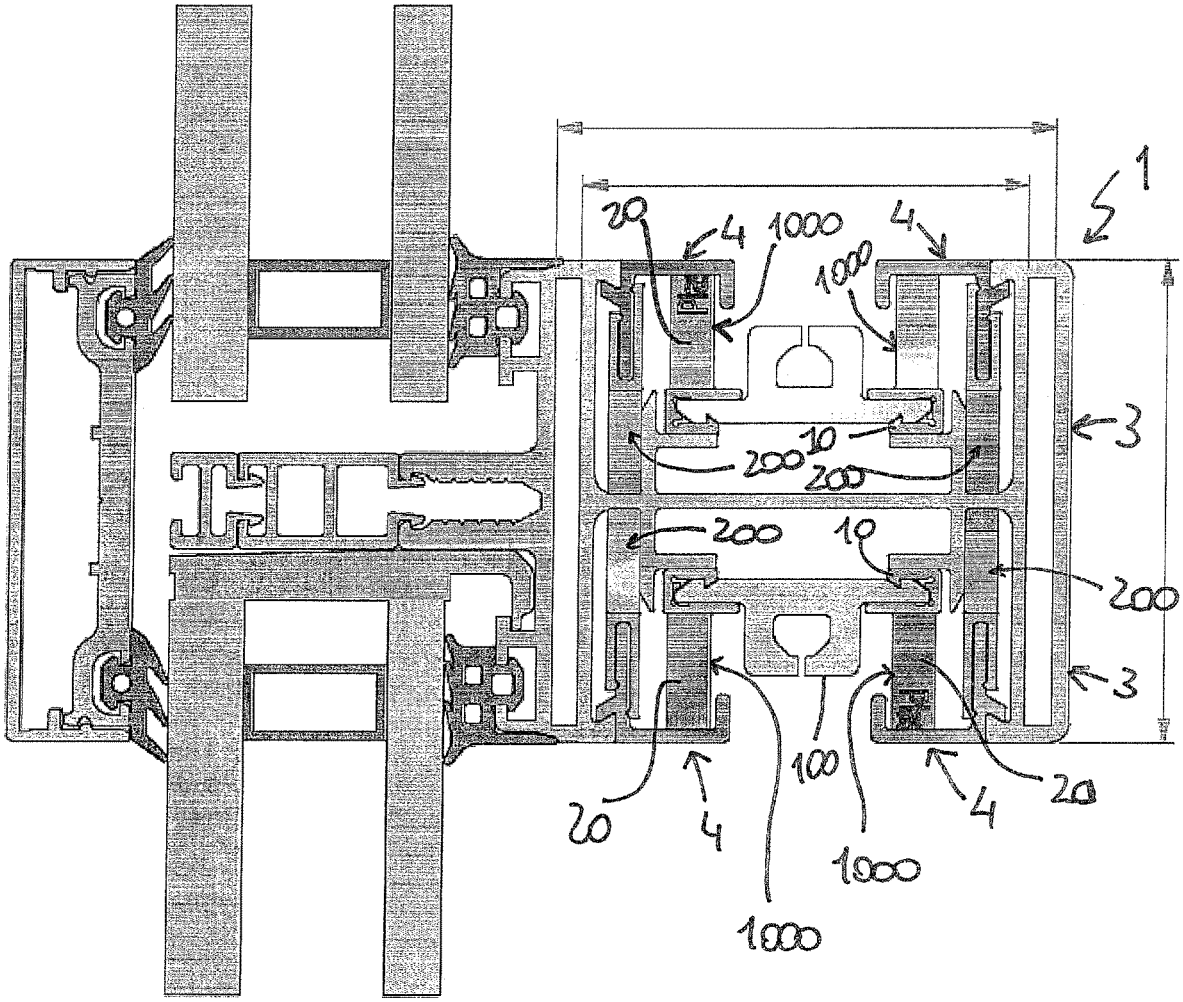
Figure 5F:
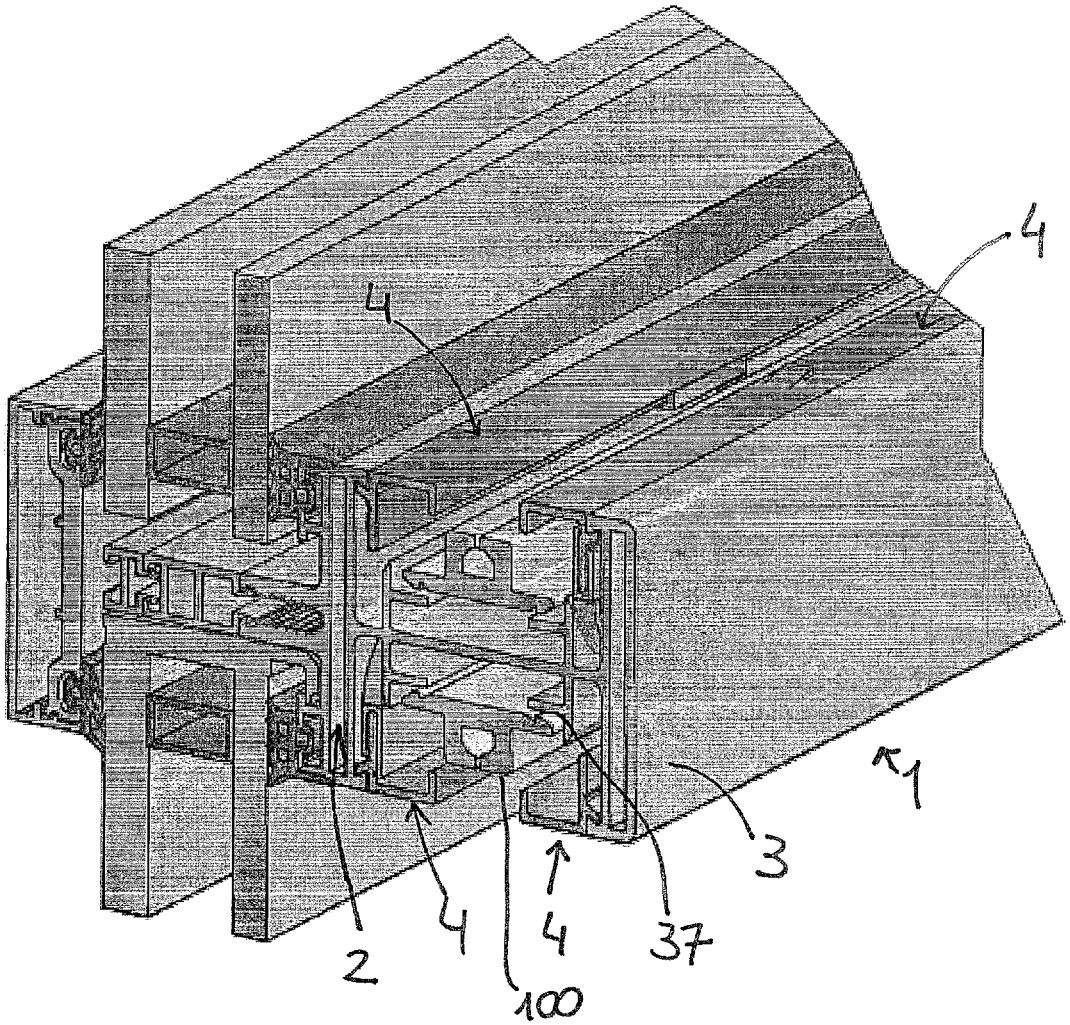
Figure 6:
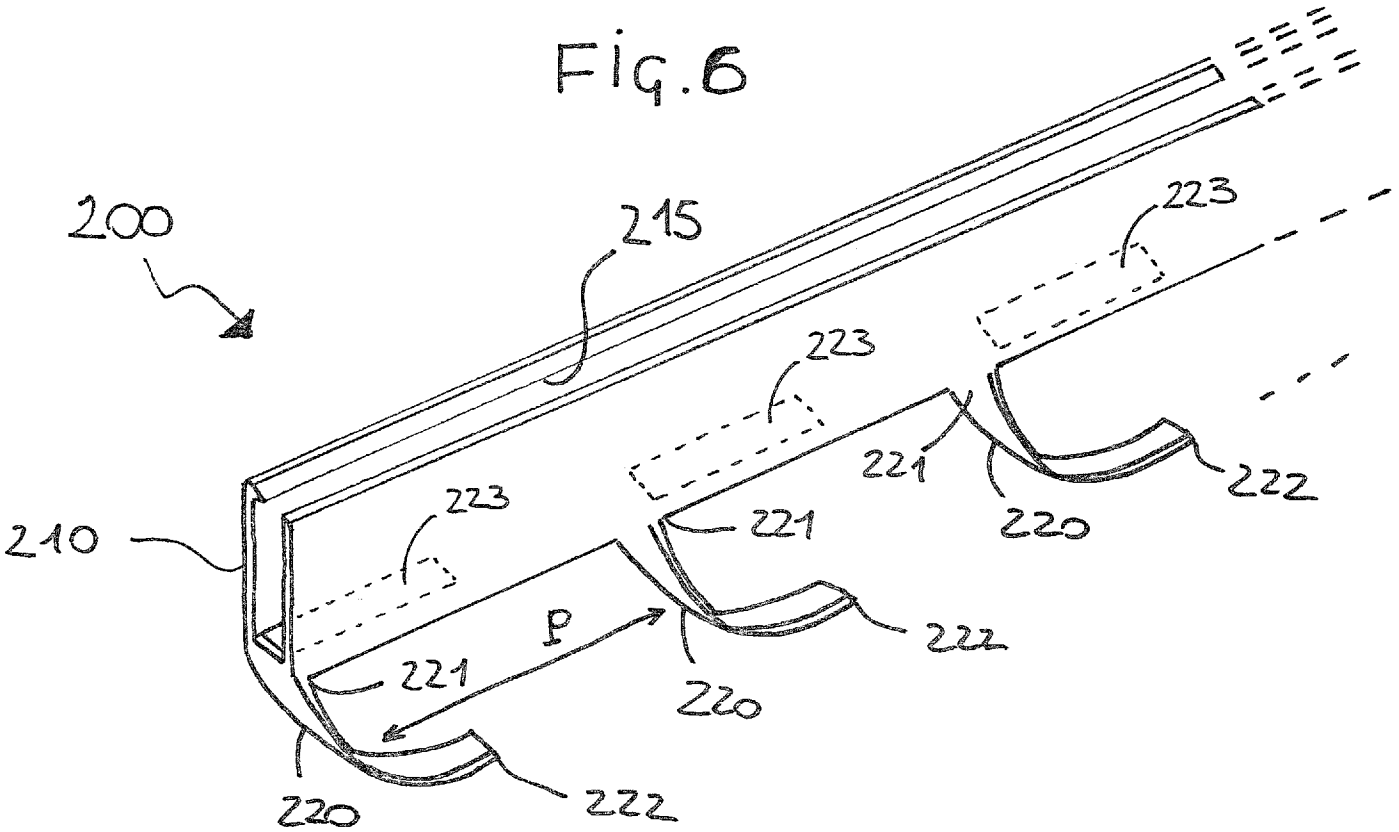
FIG. 6 shows a perspective view of a damping device, according to an embodiment of the present invention.

According to another aspect of the present invention, the upright 1 forms the so-called continuous facade of a building. In particular, with reference to FIG. 5*a*, the upright 1 has opposite flanks 2 and 3 which extend on both the sides of the base 3. The flanks 2, 3 and the base 6 form, on one side $l_a$ of the base 6, a seat S for a first profiled element 100, intended to slidably retain a first shading screen, extending towards a direction d of the continuous facade of the building, and on the other side $l_b$ of the base 6, a seat S' for a second profiled element 100 intended to retain slidably a second shading screen, extending towards a direction d' of the continuous facade. The upright 1 is therefore not walled in and its side 3 is visible on the facade of the building.

FIGS. 5*a*-5*f* show the steps for installation of four removable flanges 4 in an upright 1 for continuous facades, two flanges 4 being inserted in the seat S and the other two flanges being inserted in the seat S'.

In the figures shown, the double glazing of two adjacent windows is schematically shown on the left and the upright with the corresponding flanges are shown on the right and therefore inside the building. Obviously, it also possible for the upright and the corresponding flanges to be installed externally, forming the continuous facade on the outside of the building. The advantages of the upright, the removable flange and the elastic means for fixing the flange to the upright according to the present invention are multiple and are only briefly summarised below.

Both the flanks 2, 3 may be formed as one piece with the upright 1 and the removable flange 4 is fitted by means of snap-engagement and with extreme ease to one of the flanks 3.

According to a further aspect of the present invention, the removable flange may be mounted on the upright so as not to form the seat for receiving a profiled element of a shading screen, but to close the opening of the upright. In this case, the end face 42 of the removable flange may extend so as to touch the end face 42 of the opposite removable flange, completely closing the opening of the upright and thus forming an attractive finish on the wall. Also envisaged is an embodiment in which the removable flange is not associated with elastic means mounted on the edge but is substantially rigid, with a substantially L-shaped cross-section, and comes into contact directly with the base of the upright (i.e. without the arrangement of elastic means in between); in this case, the tooth 46 may be flexible, so as to facilitate snap-engagement of the flange in the seat. In the case where it is subsequently required to fit a shading screen, the rigid flange may be removed and a removable flange with damping means may be applied.

The integrated flanks are structurally stronger. Moreover, the flank 3 associated with the flange 4 is aesthetically attractive since it does not have holes and defines the visible end face of the upright. It is not required to apply any finishing edge, or resin or stucco, on the flange. The operations for assembly and disassembly of the flange are significantly simplified and do not require the use of any tool. The production times and costs of the upright are limited. If required, the fitting of curtains inside the upright is quick and easy.

The invention claimed is:

1. An upright, comprising:

two flanks spaced to receive a profiled element for a shading system therebetween, a first flank of the two flanks is associated with a removable flange;

a base extending between the two flanks; and at least one damping device arranged between the removable flange and the base of the upright, in order to retain the removable flange between the base and the first flank of the two flanks, wherein the at least one damping device includes:

a channel having a substantially C-shaped cross-section, wherein the channel is configured to be mounted on an edge of the removable flange before the removable flange is mounted to the first flank of the two flanks; and a flexible plastic tongue having one end on the channel and an opposite end at a distance therefrom and making contact with the base of the upright when the removable flange is mounted to the first flank of the two flanks;

wherein the first flank of the two flanks includes a locking tooth and the removable flange includes an engagement tooth adapted to engage the locking tooth between the base and the locking tooth;

wherein the at least one damping device causes the removable flange to be wedged between the base and the locking tooth, pushing the engagement tooth against the locking tooth.

2. The upright of claim 1, wherein the first flank of the two flanks comprises a rigid side wall, wherein the locking tooth is on the rigid side wall and forms an undercut in which the removable flange is engaged.

3. The upright of claim 1, wherein the removable flange comprises an end face that defines a front profile of the upright and a side wall perpendicular to the end face and comprising the edge.

4. The upright of claim 3, wherein the end face does not have holes.

5. The upright of claim 3, wherein a second flank of the two flanks of the upright comprises an end face that defines another front profile of the upright.

6. The upright of claim 5, wherein the end face of the removable flange and the end face of the second flank of the two flanks of the upright form a profile for retaining the profiled element for the shading system.

7. The upright of claim 1, wherein a second flank of the two flanks includes a removable flange, and each of the first flank and the second flank have an end face that form a profile for retaining the profiled element.

8. The upright of claim 1, wherein the at least one damping device includes a plurality of damping devices that are mounted with a predefined or variable spacing on the edge of the removable flange, the spacing being between 15 cm and 20 cm.

9. The upright of claim 6, further comprising:

the profiled element for the shading system and a plurality of clips provided with a channel having a substantially C-shaped cross-section mounted on an edge of the profiled element; and a flexible plastic tongue on a clip of the plurality of clips having one end on the channel of the clip and an opposite end at a distance therefrom and configured to contact an inner surface of the end face of each of the second flank and the removable flange, the flexible tongue on the clip being configured to act as a spring between the profiled element and the upright, allowing the profiled element to move towards the end face of each of the second flank and the removable flange during compression or be arranged at a predefined distance when there is no compression.

* * * * *